US007373913B2

(12) United States Patent
Matsuda

(10) Patent No.: US 7,373,913 B2
(45) Date of Patent: May 20, 2008

(54) SMALL INTERNAL COMBUSTION ENGINE

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/527,751

(22) Filed: Sep. 25, 2006

(65) Prior Publication Data

US 2007/0068479 A1 Mar. 29, 2007

(30) Foreign Application Priority Data

Sep. 26, 2005 (JP) ..... 2005-277568

(51) Int. Cl.
*F01M 1/02* (2006.01)
*F01M 1/04* (2006.01)
*F01M 11/02* (2006.01)

(52) U.S. Cl. ..... 123/196 R; 184/6.5

(58) Field of Classification Search ..... 123/196 R, 123/90.34, 90.33, 196 M, 196 CP, 196 A; 184/6.5

See application file for complete search history.

(56) References Cited

U.S. PATENT DOCUMENTS 4,993,378 A * 2/1991 Sakurahara et al. .... 123/196 R
6,715,460 B2 * 4/2004 Ashida et al. ..... 123/196 R
7,007,648 B2 * 3/2006 Fujikubo ..... 123/90.34
7,093,569 B2 * 8/2006 Nakatsuka et al. ..... 123/41.44
7,140,934 B2 * 11/2006 Hoi ..... 440/88 L

FOREIGN PATENT DOCUMENTS

JP 61-18166 6/1986

* cited by examiner

*Primary Examiner*—Stephen K. Cronin
*Assistant Examiner*—Hyder Ali
(74) *Attorney, Agent, or Firm*—Alleman Hall McCoy Russell & Tuttle LLP

(57) ABSTRACT

A small internal combustion engine including a crankcase, a crankshaft rotatably mounted in an interior of the crankcase by crankshaft bearings of the crankcase, a first oil passage disposed below the crankshaft bearings to extend substantially in parallel with the crankshaft, the first oil passage being configured to feed lubricating oil to the crankshaft bearings, and a second oil passage disposed at a location higher than the first oil passage to extend substantially in parallel with the first oil passage, the second oil passage being configured to feed the lubricating oil to a component other than the crankshaft bearings.

9 Claims, 4 Drawing Sheets

SMALL INTERNAL COMBUSTION ENGINE

TECHNICAL FIELD

The present invention relates to a small internal combustion engine mounted in a two-wheeled motor vehicle, a three-wheeled motor vehicle, an all terrain vehicle, a personal watercraft, etc.

BACKGROUND ART

To decrease the weight of a small internal combustion engine mounted in a two-wheeled motor vehicle, a three-wheeled motor vehicle, an all terrain vehicle, a personal watercraft, etc., the recent trend in the manufacture of small internal combustion engines is toward thinning a separating wall of a crankcase to an extent that stiffness of the crankcase is not substantially reduced.

When the internal combustion engine stops from a running state, oil may move downward in an oil passage, and air may flow into the oil passage from above. Therefore, when the engine re-starts, the air may be mixed into a lubricating oil to be fed. To increase lubrication ability or efficiency, it is desirable to avoid entry of the air into the lubricating oil. Such prior art is disclosed in Japanese Utility Model Examined Application Publication No. Sho. 61-18166.

SUMMARY OF THE INVENTION

The present invention addresses the above described conditions, and an object of the present invention is to provide a small internal combustion engine that is configured to suppress entry of air into a lubricating oil to be fed during re-start of the engine, and has a crankcase having a wall thinned without decreasing its stiffness.

According to the present invention, there is provided a small internal combustion engine comprising a crankcase; a crankshaft rotatably mounted in an interior of the crankcase by crankshaft bearings; a first oil passage disposed below the crankshaft bearings to extend substantially in parallel with the crankshaft, the first oil passage being configured to feed lubricating oil to the crankshaft bearings; and a second oil passage disposed at a location higher than the first oil passage to extend substantially in parallel with the first oil passage, the second oil passage being configured to feed the lubricating oil to a component other than the crankshaft bearings.

In accordance with the small internal combustion engine constructed above, when the small internal combustion engine stops and thereafter re-starts, air may be mixed into the lubricating oil fed to the first oil passage and the second oil passage. In this case, the air flows along with the lubricating oil toward the second oil passage located higher than the first oil passage, because the air has a specific gravity lower than that of the lubricating oil. Therefore, during re-start of the small internal combustion engine, the air is less likely to enter the lubricating oil to be fed to the first oil passage. So, the first oil passage is used as an oil feed passage for the crankshaft bearings, and the second oil passage is used as an oil feed passage for the components other than the crankshaft bearings such as a cylinder head, because the lubricating oil comparatively free from the air can be fed preferentially to the crankshaft bearings that are subjected to a relatively high load.

Preferably, the small internal combustion engine may further comprise a first rib and a second rib which are formed integrally with a wall forming the crankcase and are configured to extend substantially in parallel with the crankshaft. The first oil passage may be disposed in an interior of one of the first and second ribs, and the second oil passage is disposed in an interior of the remaining rib. In this construction, since the first rib and the second rib can improve stiffness of the wall, the wall of the crankcase having the first and second ribs can be thinned, and thus the crankcase can be made lightweight.

Preferably, the small internal combustion engine may further comprise a third oil passage extending substantially in parallel with the first oil passage and the second oil passage, the third oil passage being configured to feed the lubricating oil to a component other than the crankshaft bearings.

Preferably, the small internal combustion engine may further comprise a third rib extending substantially in parallel with the first and second ribs formed integrally with the wall; wherein the third oil passage is formed in an interior of the third rib. In this construction, stiffness of the wall can be further improved, and thus the wall can be further thinned.

Preferably, the second oil passage and the third oil passage may be disposed on opposite sides with respect to the first oil passage. In this construction, the stiffness of the wall can be efficiently improved.

Preferably, the wall may form a bottom portion of the crankcase. The second oil passage may be formed at one end portion of the wall. The third oil passage may be formed at an opposite end portion of the wall, and the first oil passage may be formed at a center portion of the wall. In this construction, the stiffness of the wall can be increased efficiently.

The small internal combustion engine may further comprise a cross oil passage configured to extend so as to cross the first oil passage, the second oil passage, and the third oil passage. The first oil passage, the second oil passage, and the third oil passage may fluidically communicate with each other through the cross oil passage. If air is mixed into the lubricating oil during, for example, re-start of the engine, the air flows to the second oil passage disposed at a higher location through the cross oil passage, and thus the lubricating oil comparatively free from air can be fed to the first oil passage or the third oil passage disposed at a lower location with a simple structure.

Preferably, the small internal combustion engine may further comprise a cross rib that is formed on the wall to extend so as to cross the crankshaft. The cross oil passage may be disposed in an interior of the cross rib. In this construction, the stiffness of the wall can be further improved.

Preferably, the cross oil passage may be coupled to a discharge passage of a lubricating oil pump. In this construction, the lubricating oil can be fed to the first and third oil passages respectively with a simple structure.

The lubricating oil pump may be disposed below the first oil passage such that the first oil passage fluidically communicates with the lubricating oil pump. Thereby, the lubricating oil can be fed to the first oil passage preferentially.

The above and further objects and features of the invention will more fully be apparent from the following detailed description with accompanying drawings.

DETAILED DESCRIPTION OF THE PREFERRED EMBODIMENTS

Hereinafter, an embodiment of a small internal combustion engine (hereinafter referred to as an engine) will be described with reference to the accompanying drawings. By way of example, an engine of a two-wheeled motor vehicle (motorcycle) will be described.

Figure 1:
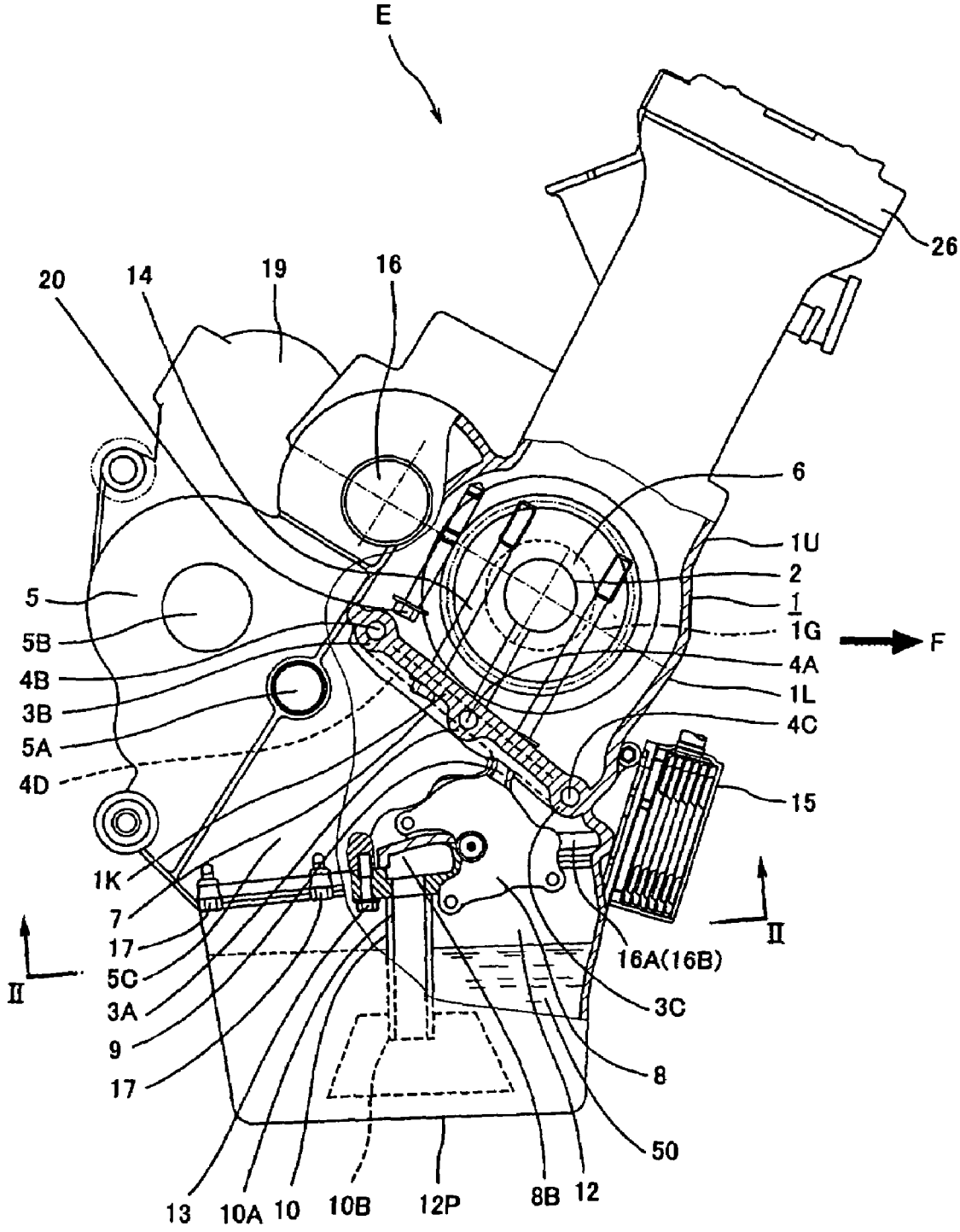
FIG. 1 is a side view showing a construction of a small internal combustion engine according to an embodiment of the present invention, a part of which is cut away.
Figure 3:
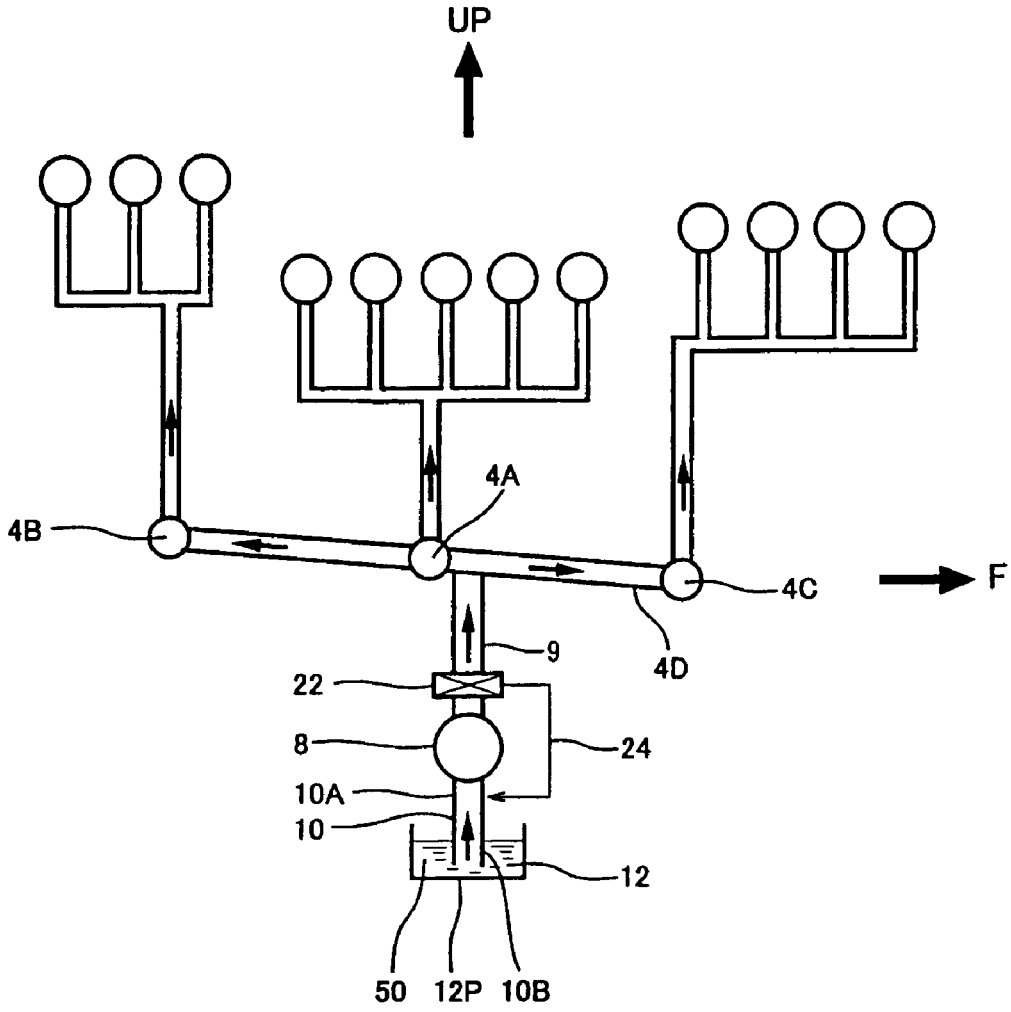
FIG. 3 is a circuit diagram schematically showing a lubricating oil passage through which lubricating oil is fed from the oil pump to components to be lubricated in the engine of FIG. 1.
Figure 4:
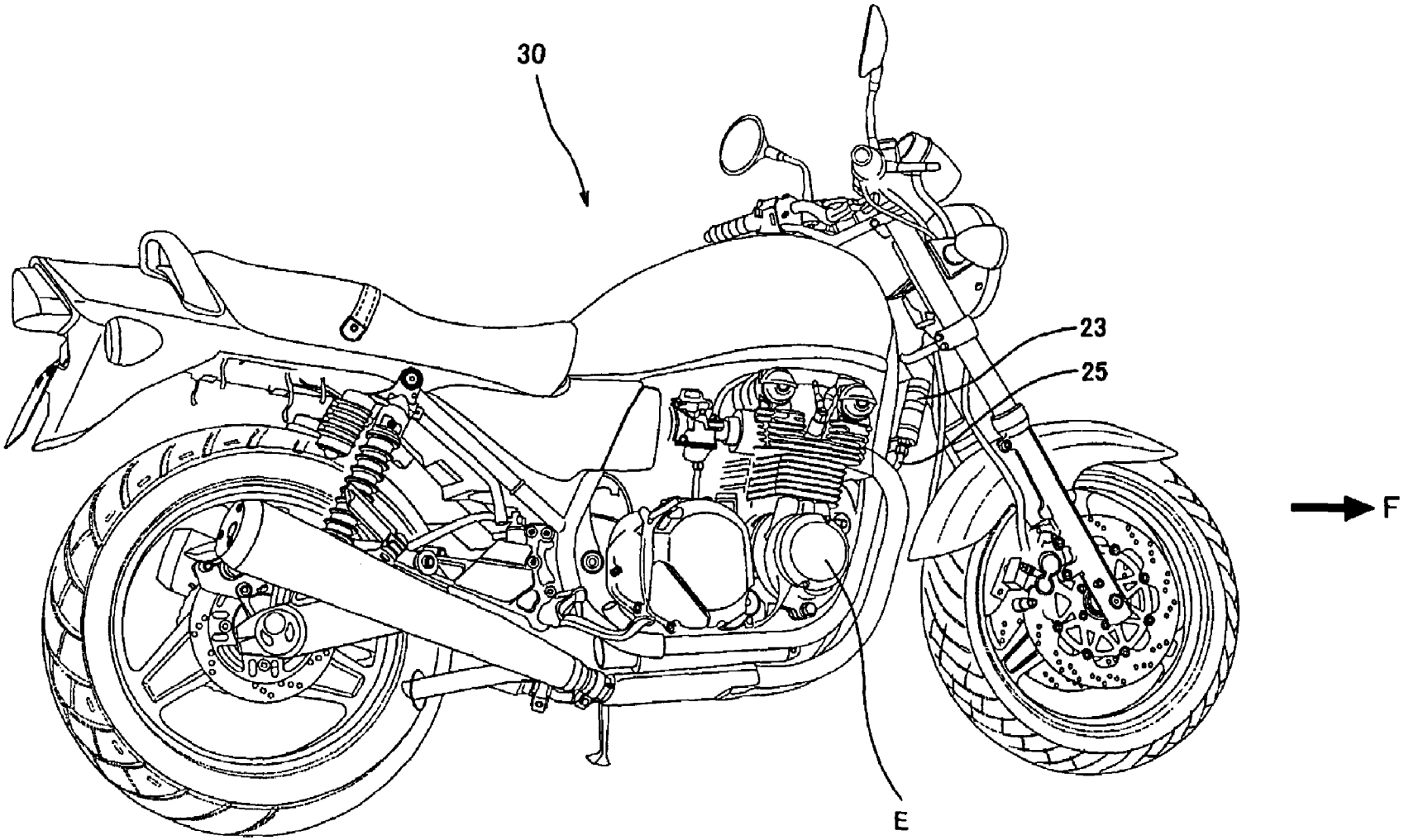
FIG. 4 is a perspective view of a two-wheeled motor vehicle in which the engine of FIG. 1 is mounted.

Turning now to FIG. 1, a four-cycle engine E which is a small internal combustion engine mounted in a motorcycle 30 of FIG. 4 is illustrated. In FIGS. 1 to 4, an arrow F indicates forward, i.e., a traveling direction of the motorcycle 30. In FIG. 1, a vertical direction of the engine E corresponds with a vertical direction of the motorcycle 30 of FIG. 4. As shown in FIG. 1, three ribs 3A, 3B, and 3C are formed integrally with a wall 1K forming a bottom portion of a crankcase 1 of the four-cycle engine E and is configured to extend substantially in parallel with a crankshaft 2. The wall 1K forms a bottom wall of a crank chamber of the crankcase 1. The crank chamber is configured to accommodate the crankshaft 2 therein. The crankcase 1 includes an upper crankcase 1U and a lower crankcase 1L which are arranged in a vertical direction. The ribs 3A, 3B, and 3C are spaced a predetermined distance apart from each other. As shown in FIG. 1, the wall 1K is tilted forward and downward.

A first oil passage 4A which is a lubricating oil passage is formed in the interior of the rib 3A. In this embodiment, the first oil passage 4A forms a main oil gallery to feed the lubricating oil to a main journal bearing (crankshaft bearing) 6 of the crankshaft 2. As shown in FIG. 1, the first oil passage 4A is located below the main journal bearing 6 of the crankshaft 2.

A second oil passage 4B which is a lubricating oil passage is formed in the interior of the rib 3B. The second oil passage 4B forms a first sub-oil gallery to feed the lubricating oil to bearings mounted on an input shaft 5A and an output shaft 5B of a transmission 5, and components in a cylinder head 26 to be lubricated, such as a bearing of a camshaft, and a contact surface between a cam and a cam follower.

A third oil passage 4C which is a lubricating oil passage is formed in the interior of the rib 3C. In this embodiment, the third oil passage 4C forms a second sub-oil gallery to feed the lubricating oil to slidable portions of pistons of respective cylinders of the engine.

A cross rib 7 is formed on the wall 1K forming the bottom portion of the crankcase 1 and is configured to extend at substantially center regions in the longitudinal direction of the ribs 3A, 3B, and 3C (or crankshaft 2) so as to cross the ribs 3A, 3B, and 3C, in this embodiment, at a right angle. A cross oil passage 4D is formed in the interior of the cross rib 7. The cross oil passage 4D is fluidically coupled to each of the first oil passage 4A to the third oil passage 4C. A downstream end portion of a discharge passage 9 (see FIG. 1) in an oil flow direction is coupled to a location in close proximity to a center position in the longitudinal direction of the cross oil passage 4D, i.e., a cross point of the cross oil passage 4D and the first oil passage 4A, and an upstream end thereof is coupled to an outlet 8A (see FIG. 2) of the oil pump 8. In this construction, the lubricating oil is fed with a predetermined pressure from the oil pump 8 to the first oil passage 4A, the second oil passage 4B, and the third oil passage 4C through the discharge passage 9 and the cross oil passage 4D.

As shown in FIGS. 1 and 3, in this embodiment, the second oil passage 4B is located higher than the first oil passage 4A, and the third oil passage 4C is located lower than the first oil passage 4A. The second oil passage 4B is located rearward (leftward in FIGS. 1 and 3) relative to the first oil passage 4A, and the third oil passage 4C is located forward (rightward in FIGS. 1 and 3) relative to the first oil passage 4A. That is, the second oil passage 4B and the third oil passage 4C are located on opposite sides relative to the first oil passage 4A. FIG. 3 illustrates a relative relationship between the first oil passage 4A, the second oil passage 4B, and the third oil passage 4C in a vertical direction and in a forward and rearward direction. It should be appreciated that FIG. 3 is not intended to illustrate absolute dimensions in the vertical direction and in the forward and rearward direction.

The oil pump 8 is disposed in a transmission case 5C below the first oil passage 4A forming the main oil gallery. An inlet 8B of the oil pump 8 is coupled to a downstream end portion 10B of a suction pipe (suction passage) 10 and an upstream end portion 10B of the suction pipe 10 is immersed in oil 50 reserved in an oil reservoir 12 of the engine E. The oil pump 8 suctions the oil 50 from inside the oil reservoir 12 through the suction pipe 10. In this embodiment, the transmission case 5C is fluidically connected to the oil reservoir 12.

In this embodiment, the oil pump 8 is separable from the engine E. The oil pump 8 is removably mounted to the transmission case 5C of the engine E by a plurality of mounting bolts 13. By removing the mounting bolts 13, the oil pump 8 can be easily removed from the transmission case 5C. To be specific, an oil pan 12P forming an outer shell of the oil reservoir 12 is detached from the transmission case 5C by removing mounting bolts 17 and then the oil pump 8 is removed from the transmission case 5C by removing the mounting bolts 13. Thereby, the bottom portion of the crankcase 1 is exposed as viewed from below of the engine E. In this state, by removing mounting bolts 14 of the main journal and mounting bolts 20 described later, the lower crankcase 1L can be moved downward to be removed. Therefore, an operator can easily inspect connecting rods (not shown), pistons (not shown), the crankshaft 2, and so on in the interior of the crankcase 1 from below the crankcase 1.

In this embodiment, the oil pump 8 is disposed below the first oil passage 4A. As shown in FIG. 3, a relief valve unit 22 is provided in the discharge passage 9 of the oil pump 8. When the relief valve unit 22 operates to open a relief valve thereof, the pressurized lubricating oil flowing in the discharge passage 9 is flowed to a relief passage 24 extending from the relief valve unit 22, and is returned to the suction pipe (suction passage) 10 of the oil pump 8 to which a downstream end portion of the relief passage 24 is coupled. In FIG. 3, an arrow UP indicates upward.

Figure 2:
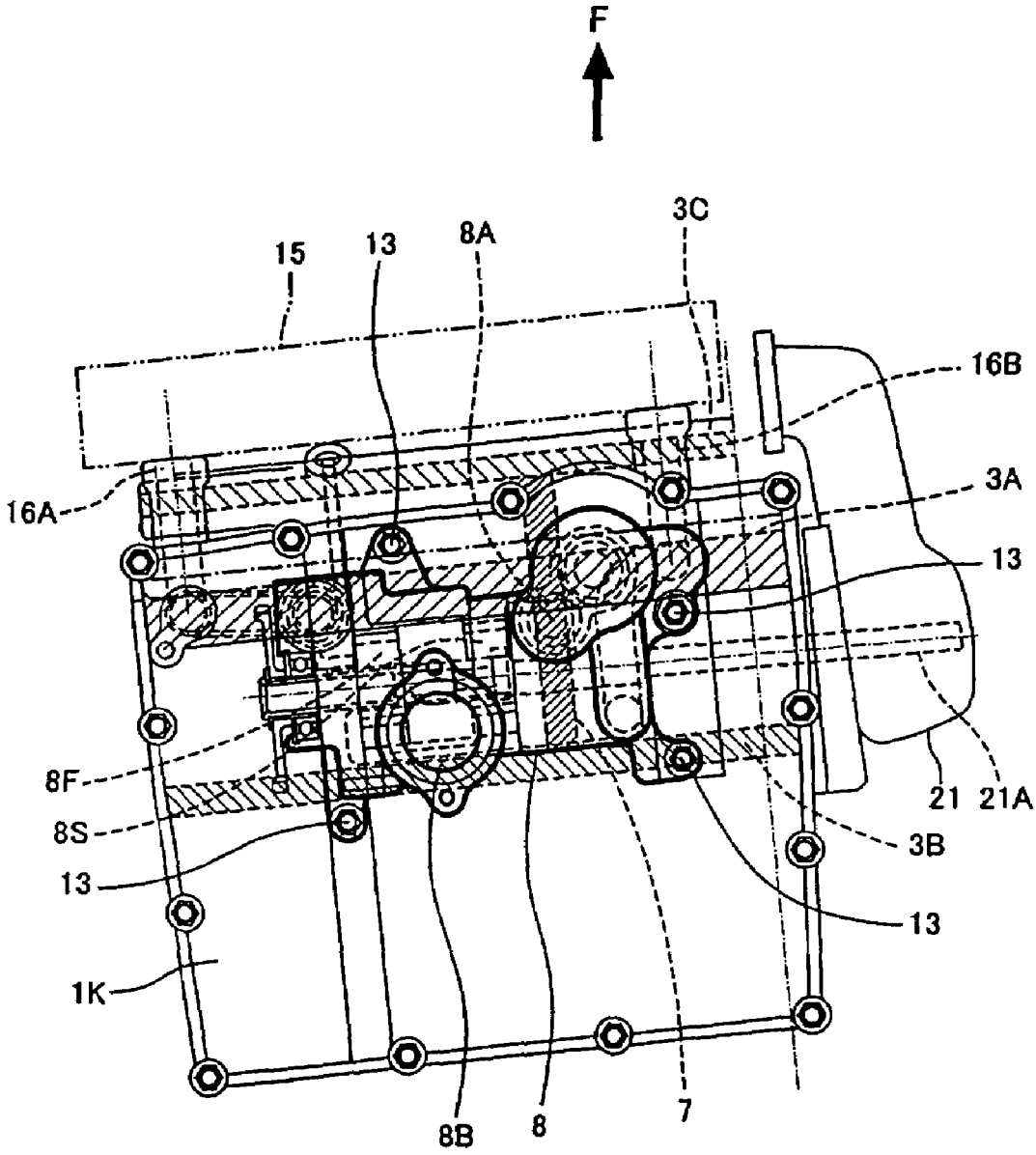
FIG. 2 is a view taken in the direction of arrows along line II-II of FIG. 1, showing a bottom portion of a crankcase of the internal combustion engine of FIG. 1 and an oil pump disposed therein.

Turning now to FIG. 2, the oil pump 8 is fluidically coupled to an oil cooler 15 (see FIGS. 1 and 2) disposed forward of the engine E (rightward in FIG. 1) by passages 16A and 16B. A rightward and leftward direction in FIG. 2 corresponds with a rightward and leftward direction of the engine E. The oil cooler 15 is capable of effectively cooling the lubricating oil fed to the components of the engine E to be lubricated. A first pump chamber 8F of the oil pump 8 causes the lubricating oil to be fed with pressure from the oil reservoir 12 (see FIG. 1) to the oil cooler 15. The lubricating oil is cooled by the oil cooler 15 and flows to a second pump chamber 8S of the oil pump 8. The second pump chamber 8S causes the lubricating oil to be fed with pressure to the discharge passage 9 (see FIG. 1). The oil pump 8 includes two pump chambers, namely the first pump chamber 8F that feeds the lubricating oil to the oil cooler 15 and the second pump chamber 8S that feeds the lubricating oil to the discharge passage 9.

In this embodiment, as shown in FIG. 1, the crankshaft 2 is located at a parting plane 1G between the upper crankcase 1U and the lower crankcase 1L. The upper crankcase 1U and the lower crankcase 1L are assembled together by the plurality of mounting bolts 20, and so on. In FIG. 1, 16 denotes a rotational shaft of a balancer of the engine E, and 19 denotes a generator.

The construction of engine E described above achieves advantages as described below. Since the first oil passage 4A is positioned in close proximity to a connecting portion where the discharge passage 9 and the cross oil passage 4D are coupled to each other, the lubricating oil can be fed preferentially to the first oil passage 4A (main oil gallery). This makes it possible to feed an adequate amount of lubricating oil to the main journal bearing (crankshaft bearing) that is subjected to a relatively high load.

For example, upon re-start of the engine E, air may in some cases be mixed into the lubricating oil. If the lubricating oil fed from the discharge passage 9 to the cross oil passage 4D contains air, air flows along with the lubricating oil toward the second oil passage 4B at a higher location, and therefore, the lubricating oil fed to the first oil passage 4A and the third oil passage 4C contains comparatively little (i.e., less) air. As a result, during the re-start of the engine E, lubricating oil that is comparatively free from air is fed to the first oil passage 4A and the third oil passage 4C, relatively preferentially.

Since the ribs 3A to 3C are disposed on the wall 1K of the bottom portion of the crankcase 1 to be spaced apart from each other and to extend substantially in parallel with the crankshaft 2, and the cross rib 7 is disposed at the center regions in the longitudinal direction of the ribs 3A to 3C so as to cross the crankshaft 2, stiffness of the wall 1K of the bottom portion of the crankcase 1 is improved. This makes it possible to reduce vibration of the engine E. In addition, since the provision of the ribs 3A to 3C and the cross rib 7 can improve the stiffness of the wall 1K of the bottom portion of he crankcase 1, the wall 1K can be thinned.

Upon the operation of the relief valve unit 22 provided in the discharge passage 9 of the oil pump 8, the pressurized oil is returned from the discharge passage 9 to the suction pipe 10 of the oil pump 8 through the relief passage 24 extending from the relief valve unit 22. This makes it possible to efficiently utilize the energy of the lubricating oil pressurized by the oil pump 8.

As shown in FIG. 2, since the engine E is constructed such that a rotational shaft of the oil pump 8 and a rotational shaft 21 A of a water pump 21 are formed by a common shaft, the water pump 21 is disposed in close proximity to a front end of the engine E. Thereby, a distance between the water pump 21 and a radiator 23 (see FIG. 4) can be decreased. This makes it possible to decrease the length of a pipe 25 (see FIG. 4) or a hose (not shown) coupling the water pump 21 to the radiator 23. As a result, desirably, the external appearance of the motorcycle 30, which is an important factor that determines its commercial value, is not substantially affected.

Whereas the small internal combustion engine mounted in the motorcycle has been described in this embodiment, the present invention is applicable to small internal combustion engines for leisure vehicles other than the motorcycle.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A small internal combustion engine comprising:

a crankcase;

a crankshaft rotatably mounted in an interior of the crankcase by crankshaft bearings;

a first oil passage disposed below the crankshaft bearings to extend substantially in parallel with the crankshaft, the first oil passage being configured to feed lubricating oil to the crankshaft bearings;

a second oil passage disposed at a location higher than the first oil passage to extend substantially in parallel with the first oil passage, the second oil passage being configured to feed the lubricating oil to a component other than the crankshaft bearings;

a third oil passage extending substantially in parallel with the first oil passage and the second oil passage, the third oil passage being configured to feed the lubricating oil to a component other than the crankshaft bearings; and a cross oil passage configured to extend so as to cross the first oil passage, the second oil passage, and the third oil passage;

wherein the first oil passage, the second oil passage, and the third oil passage fluidically communicate with each other through the cross oil passage.

2. The small internal combustion engine according to claim 1, further comprising:

a first rib and a second rib which are formed integrally with a wall forming the crankcase and are configured to extend substantially in parallel with the crankshaft;

wherein the first oil passage is disposed in an interior of one of the first and second ribs, and the second oil passage is disposed in an interior of the remaining rib; and a third rib extending substantially in parallel with the first and second ribs formed integrally with the wall;

wherein the third oil passage is formed in an interior of the third rib.

3. The small internal combustion engine according to claim 1, wherein the second oil passage and the third oil passage are disposed on opposite sides with respect to the first oil passage.

4. The small internal combustion engine according to claim 3, wherein the wall forms a bottom portion of the crankcase; and wherein the second oil passage is formed at one end portion of the wall, the third oil passage is formed at an opposite end portion of the wall, and the first oil passage is formed at a center portion of the wall.

5. A small internal combustion engine comprising:

a crankcase:

a crankshaft rotatably mounted in an interior of the crankcase by crankshaft bearings;

a first oil passage disposed below the crankshaft bearings to extend substantially in parallel with the crankshaft, the first oil passage being configured to feed lubricating oil to the crankshaft bearings;

a second oil passage disposed at a location higher than the first oil passage to extend substantially in parallel with the first oil passage, the second oil passage being configured to feed the lubricating oil to a component other than the crankshaft bearings; and a third oil passage extending substantially in parallel with the first oil passage and the second oil passage, the third oil passage being configured to feed the lubricating oil to a component other than the crankshaft bearings; and a first rib and a second rib which are formed integrally with a wall forming the crankcase and are configured to extend substantially in parallel with the crankshaft;

wherein the first oil passage is disposed in an interior of one of the first and second ribs, and the second oil passage is disposed in an interior of the remaining rib;

a third oil passage extending substantially in parallel with the first oil passage and the second oil passage, the third oil passage being configured to feed the lubricating oil to a component other than the crankshaft bearings; and a cross oil passage configured to extend so as to cross the first oil passage, the second oil passage, and the third oil passage;

wherein the first oil passage, the second oil passage, and the third oil passage fluidically communicate with each other through the cross oil passage.

6. The small internal combustion engine according to claim 5, further comprising:

a cross rib that is formed on the wall to extend so as to cross the crankshaft;

wherein the cross oil passage is disposed in an interior of the cross rib.

7. The small internal combustion engine according to claim 6, wherein the cross oil passage is coupled to a discharge passage of a lubricating oil pump.

8. The small internal combustion engine according to claim 7, wherein the lubricating oil pump is disposed below the first oil passage such that the first oil passage fluidically communicates with the lubricating oil pump.

9. A small internal combustion engine comprising:

a crankcase;

a crankshaft rotatably mounted in an interior of the crankcase by crankshaft bearings;

a first oil passage disposed below the crankshaft bearings to extend substantially in parallel with the crankshaft, the first oil passage being configured to feed lubricating oil to the crankshaft bearings;

a second oil passage disposed at a location higher than the first oil passage to extend substantially in parallel with the first oil passage, the second oil passage being configured to feed the lubricating oil to a component other than the crankshaft bearings;

a third oil passage extending substantially in parallel with the first oil passage and the second oil passage, the third oil passage being configured to feed the lubricating oil to a component other than the crankshaft bearings;

a first rib and a second rib which are formed integrally with a wall forming the crankcase and are configured to extend substantially in parallel with the crankshaft;

wherein the first oil passage is disposed in an interior of one of the first and second ribs, and the second oil passage is disposed in an interior of the remaining rib; and a third rib extending substantially in parallel with the first and second ribs formed integrally with the wall;

wherein the third oil passage is formed in an interior of the third rib; and wherein the second oil passage is formed at one end portion of the wall, the third oil passage is formed at an opposite end portion of the wall, and the first oil passage is formed at a center portion of the wall.

* * * * *